US005226659A

United States Patent [19]

Lo

[11] Patent Number: 5,226,659

[45] Date of Patent: Jul. 13, 1993

[54] GOLF CLUB HEAD

[76] Inventor: Kun-Nan Lo, No. 33, Hsiang-Ho Rd., Li-Lin Tsun, Tan-Tzu Hsiang, Taichung Hsien, Taiwan

[21] Appl. No.: 998,811

[22] Filed: Dec. 30, 1992

[51] Int. Cl.[5] ..... A63B 53/04

[52] U.S. Cl. ..... 273/167 H; 273/80.3; 273/169; 273/173; 273/DIG. 23

[58] Field of Search ..... 273/80.2, 80.3, 167 R-77 A, 273/193 R, 194 R, 194 A, 194 B, DIG. 23, 164.1, 77 R, 162 R

[56] References Cited

U.S. PATENT DOCUMENTS

| | | | |
|---|---|---|---|
| 3,814,437 | 6/1974 | Winquist | 273/167 R |
| 4,438,931 | 3/1984 | Motomiya | 273/167 H |
| 4,582,321 | 4/1986 | Yoneyama | 273/78 |
| 4,653,756 | 3/1987 | Sato | 273/167 E |
| 4,664,383 | 5/1987 | Aizawa | 273/78 |
| 4,697,814 | 10/1987 | Yamada | 273/169 |
| 4,699,383 | 10/1987 | Kobayashi | 273/169 |
| 4,715,601 | 12/1987 | Lamanna | 273/77 A |
| 4,852,880 | 8/1989 | Kobayashi | 273/169 |
| 4,874,171 | 10/1989 | Ezaki et al. | 273/77 A |
| 4,991,843 | 2/1991 | Mori | 273/80.3 |

*Primary Examiner*—V. Millin
*Assistant Examiner*—Sebastian Passaniti
*Attorney, Agent, or Firm*—Curtis, Morris & Safford

[57] ABSTRACT

A golf club head has a metal main body with a toe, a heel, a front hitting portion which widens gradually from the heel to the toe, a rear portion opposite to the front hitting portion and formed with a cavity and an annular groove which is disposed around the cavity, and a sole portion which extends between the toe and the heel at lower ends of the front and rear portions. The main body is formed with a curved peripheral groove of predetermined width which extends from the front hitting portion to the rear portion and which is formed adjacent to the heel. The peripheral groove is communicated with the cavity and the annular groove and has two ends which terminate adjacent to the sole portion. The main body further has a hosel with a diameter reduced portion which extends obliquely upward from the heel. A layer of carbon fiber reinforced resin material is provided around the diameter reduced portion and extends into the peripheral groove. A mass of carbon fiber reinforced resin material fills the cavity and the annular groove and is connected integrally to the layer of resin material.

2 Claims, 5 Drawing Sheets

| | TOTAL WEIGHT | TOTAL VOLUME | MEAN DENSITY | HOSEL WEIGHT | WEIGHT (STAINLESS STEEL) | WEIGHT (CARBON FIBER REINFORCED RESIN) | THCKNESS (HITTING AREA) | WEIGHT OF RESIN MASS |
|---|---|---|---|---|---|---|---|---|
| CONVENTIONAL NO.5 IRON (STAINLESS STEEL) | 256g | 32.82cc | 7.8g/cc | 64g | 256g | 0 | 4-6mm | 0 |
| NO.5 IRON (PRESENT IN ENTION) | 256g | 59.29cc | 4.32g/cc | 40g | 211g | 45g | 3mm | 40g |

FIG. 6

GOLF CLUB HEAD

BACKGROUND OF THE INVENTION

1. Field of the Invention

The invention relates to a golf club head, more particularly to a golf club head which has a metal main body that is formed with a cavity at a rear portion, and a mass of carbon fiber reinforced resin material that fills the cavity.

2. Description of the Related Art

Golf club heads which are made entirely from stainless steel are known in the art. Aside from possessing good strength and rigidity, stainless steel golf club heads have a relatively low cost.

However, because stainless steel has a relatively high density, and because the size of the golf club head is relatively small, it is difficult to design the weight distribution of the golf club head in order to achieve the characteristics of an ideal golf club head.

Golf club heads which include a metal member and a carbon fiber reinforced resin member are also known in the art. For example, U.S. Pat. No. 4,664,383 discloses a golf club head which has a metal core that is covered by a layer of fiber reinforced synthetic resin material. U.S. Pat. Nos. 4,667,963, 4,699,383, 4,697,814 and 4,874,171 all disclose a golf club head which has a main body that is made of carbon fiber reinforced resin and that is fixed integrally on a metal sole member.

SUMMARY OF THE INVENTION

The main objective of the present invention is to provide a golf club head which has a gravity center that is disposed close to a wide toe portion thereof, thereby resulting in a larger sweet spot.

Another objective of the present invention is to provide a golf club head which has a gravity center that is disposed closer to the sole portion thereof, thus resulting in a greater inertial moment so as to achieve a longer hitting distance.

Accordingly, the preferred embodiment of a golf club head of the present invention comprises:

a metal main body with a toe, a heel, a front hitting portion which widens gradually from the heel to the toe, a rear portion opposite to the front hitting portion and formed with a cavity and an annular groove which is disposed around the cavity, and a sole portion which extends between the toe and the heel at lower ends of the front and rear portions, the main body being formed with a curved peripheral groove of predetermined width which extends from the front hitting portion to the rear portion and which is formed adjacent to the heel, the peripheral groove being communicated with the cavity and the annular groove and having two ends which terminate adjacent to the sole portion, the main body further having a hosel with a diameter reduced portion which extends obliquely upward from the heel;

a layer of carbon fiber reinforced resin material being provided around the diameter reduced portion and extending into the peripheral groove; and a mass of carbon fiber reinforced resin material filling the cavity and the annular groove and being connected integrally to the layer of resin material.

In one aspect of the present invention, the main body further has a plurality of ribs which project from the rear portion into the cavity in order to strengthen the connection between the main body and the mass of resin material.

BRIEF DESCRIPTION OF THE DRAWINGS

Other features and advantages of the present invention will become apparent in the following detailed description of the preferred embodiments, with reference to the accompanying drawings, of which:

FIG. 6 is a table which illustrates the differences between a conventional stainless steel golf club head and the golf club head of the present invention.

DETAILED DESCRIPTION OF THE PREFERRED EMBODIMENTS

Figure 4:
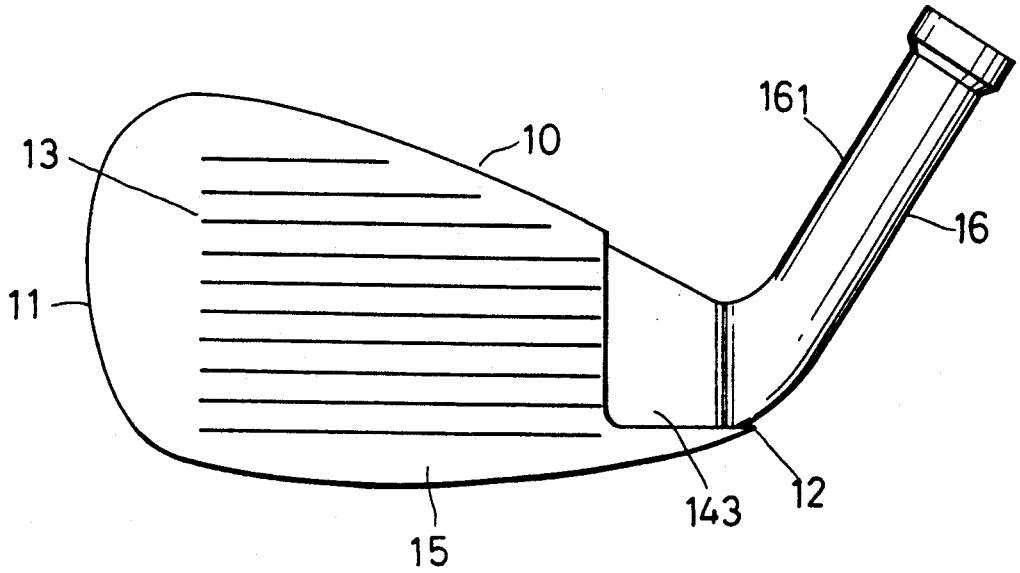
FIG. 4 is a front view of a metal main body of the preferred embodiment.
Figure 5:
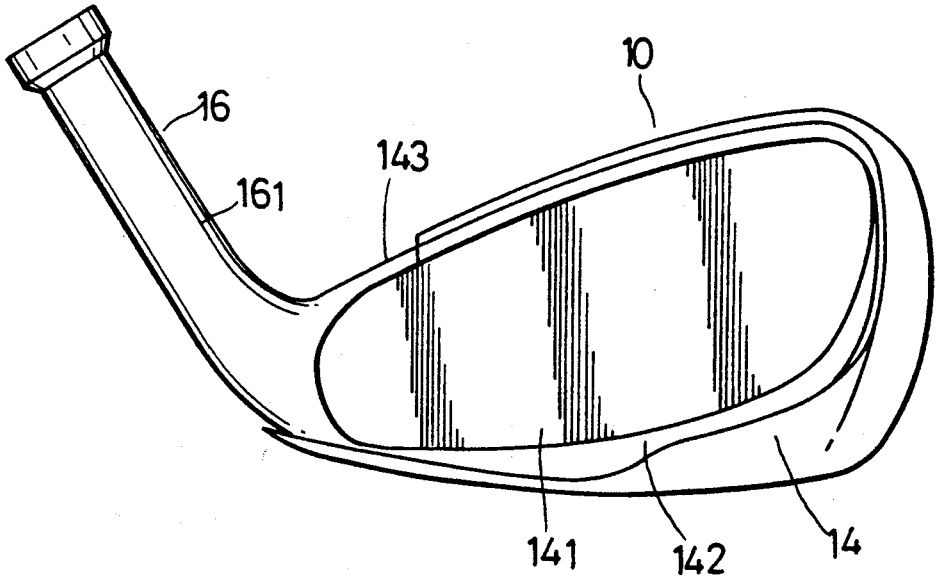
FIG. 5 is a rear view of the metal main body shown in FIG. 4.

Referring to FIGS. 4 and 5, the preferred embodiment of a golf club head according to the present invention is shown to comprise an integrally formed main body (10) which is preferably made entirely of stainless steel metal. The main body (10) has a toe (11), a heel (12), a front hitting portion (13) to hit a golf ball, a rear portion (14) opposite to the front hitting portion (13), and a sole portion (15) which extends between the toe (11) and the heel (12) at lower ends of the front and rear portions (13, 14). The rear portion (14) is formed with a cavity (141) and an annular groove (142) which is disposed around the cavity (141). The main body (10) is formed with a curved peripheral groove (143) of predetermined width which extends from the front hitting portion (13) to the rear portion (14) and which is formed adjacent to the heel (12). The peripheral groove (143) is communicated with the cavity (141) and the annular groove (142) and has two ends which terminate adjacent to the sole portion (15). The main body (10) further has a hosel (16) which has a diameter reduced portion (161) that extends obliquely upward from the heel (12).

Figure 1:
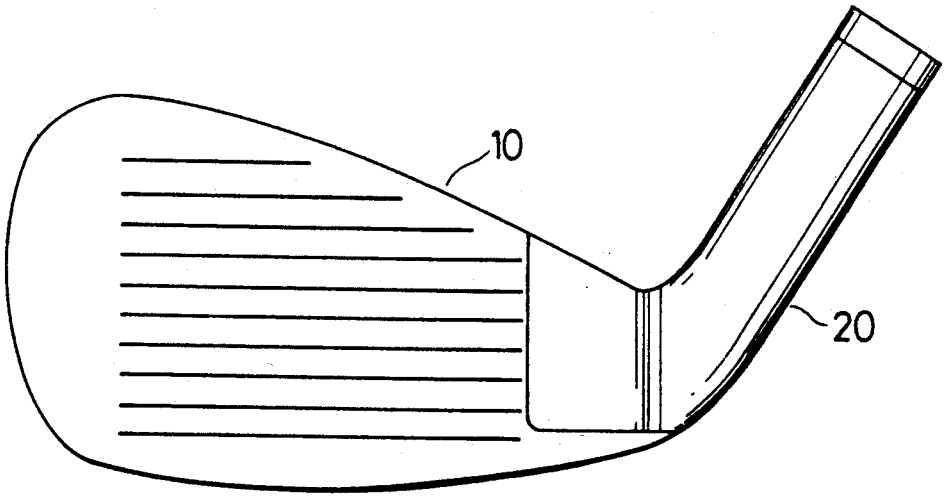
FIG. 1 is a front view of the preferred embodiment of a golf club head according to the present invention.
Figure 2:
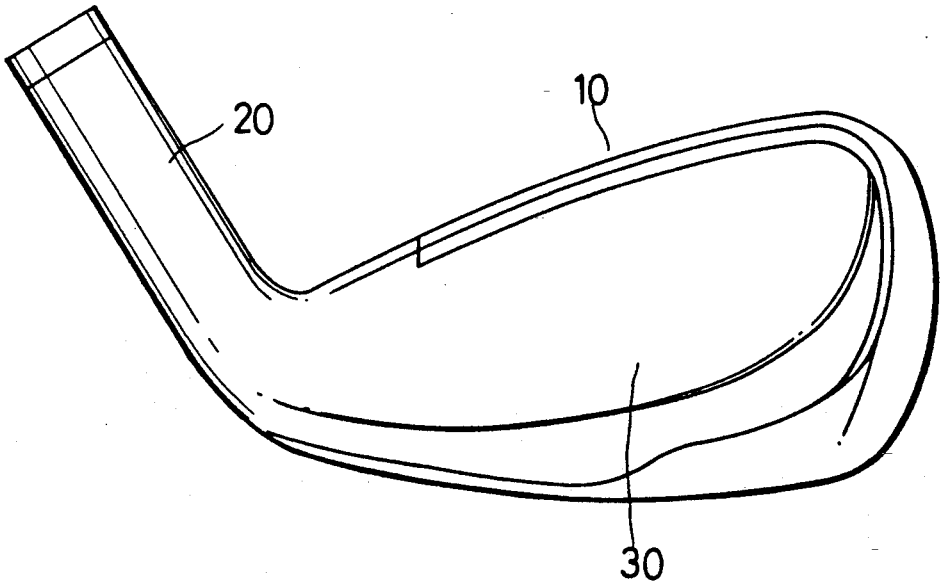
FIG. 2 is a rear view of the preferred embodiment.
Figure 3:
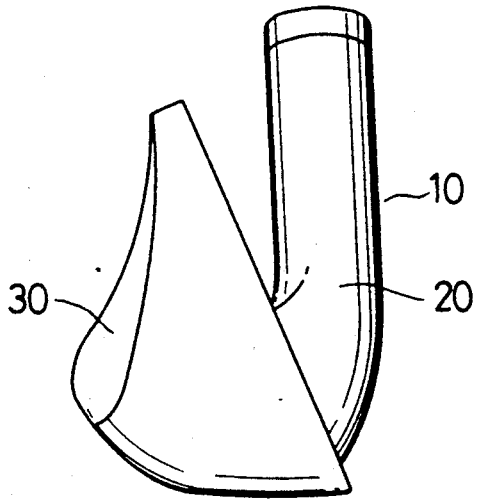
FIG. 3 is a schematic side view of the preferred embodiment.

Referring to FIGS. 1, 2 and 3, a layer (20) of carbon fiber reinforced resin material is wrapped around the diameter reduced portion (161) and extends into the peripheral groove (143). A mass (30) of carbon fiber reinforced resin material is connected integrally to the layer (20) of resin material and fills the cavity (141) and the annular groove (142).

The process steps for manufacturing the preferred embodiment of a golf club head according to the present invention are as follows:

Step 1: High precision casting is conducted so as to form the metal main body. The main body is preferably made of 17.4 PH, SUS 304 or SUS 431 stainless steel. Other types of metal may be used, such as copper or metal alloy.

Step 2: The rear portion and the hosel of the main body are sandblasted so as to facilitate the attachment of resin material thereto.

Step 3: Carbon fiber reinforced resin material, which may be in the form of strips, tape or pellets, is wrapped around the hosel and fills the cavity in the rear portion of the main body, thereby completing the golf club head.

Step 4: The golf club head is then placed in a mold and is cured for 15 to 45 minutes. The golf club head is cooled and undergoes a finishing stage afterwards.

It is known that a ball must be hit at the sweet spot of the golf club head in order to achieve a longer hitting distance and better ball control. Referring to FIGS. 1 and 6, because the weight of the main body (10) at the hosel (16) and at the heel (12) thereof has been reduced, the gravity center of the main body (10) is shifted toward the toe (11). Note that the front hitting portion (13) widens gradually from the heel (12) to the toe (11). Therefore, shifting of the gravity center toward the toe (11) results in an increase in the area of the sweet spot. The possibility that a golfer will hit the ball at the sweet spot of the club head is thus increased, thereby ensuring that a longer hitting distance and better ball control ball will be achieved when the golf club head of the present invention is in use.

Furthermore, the mass (30) of resin material in the cavity (141) of the metal body (10) permits the shifting of the gravity center to a point which is closer to the sole portion (15). A greater inertial moment is obtained, thereby ensuring that a longer hitting distance is possible when the present invention is in use.

Note that the front hitting portion and the sole portion of the main body (10) are made of stainless steel, thereby retaining the anti-abrasive and impact-resistant properties of the conventional golf club head.

Figure 7:
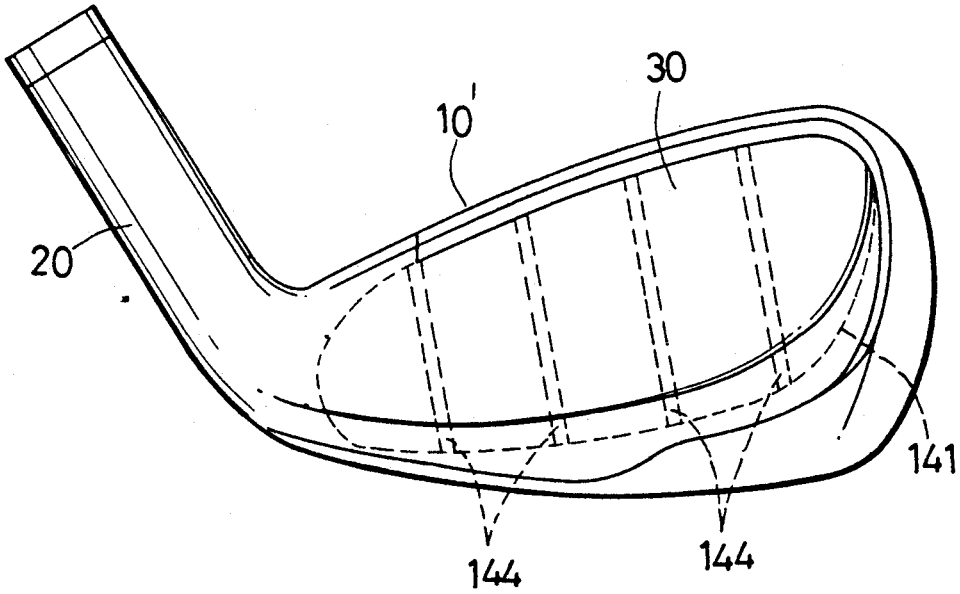
FIG. 7 is a rear perspective view of the second preferred embodiment of a golf club head according to the present invention.

Referring to FIG. 7, the second preferred embodiment of a golf club head according to the present invention is shown to be substantially similar in construction to the preceding embodiment. The main body (10') of the second preferred embodiment, however, has a plurality of ribs (44) which project from the rear portion (14) into the cavity (141), thereby strengthening the connection between the mass (30) of resin material in the cavity (141) and the main body (10').

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A golf club head, comprising:

a metal main body with a toe, a heel, a front hitting portion which widens gradually from said heel to said toe, a rear portion opposite to said front hitting portion and formed with a cavity and an annular groove which is disposed around said cavity, and a sole portion which extends between said toe and said heel at lower ends of said front and rear portions, said main body being formed with a curved peripheral groove of predetermined width which extends from said front hitting portion to said rear portion and which is formed adjacent to said heel, said peripheral groove being communicated with said cavity and said annular groove and having two ends which terminate adjacent to said sole portion, said main body further having a hosel with a diameter reduced portion which extends obliquely upward from said heel;

a layer of carbon fiber reinforced resin material being provided around said diameter reduced portion and extending into said peripheral groove; and a mass of carbon fiber reinforced resin material filling said cavity and said annular groove and being connected integrally to said layer of resin material.

2. The golf club head as claimed in claim 1, wherein said main body further has a plurality of ribs which project from said rear portion into said cavity.

* * * * *